United States Patent [19]

Miyagi et al.

[11] 4,172,509

[45] Oct. 30, 1979

[54] TRACTION MACHINE OF ELEVATOR

[75] Inventors: Akira Miyagi; Kazutoshi Ohta, both of Inazawa, Japan

[73] Assignee: Mitsubishi Denki Kabushiki Kaisha, Tokyo, Japan

[21] Appl. No.: 857,997

[22] Filed: Dec. 6, 1977

[30] Foreign Application Priority Data

Dec. 7, 1976 [JP] Japan ..... 51-146769

[51] Int. Cl.[2] ..... B66B 5/02; B66B 7/12

[52] U.S. Cl. ..... 187/1 R

[58] Field of Search ..... 187/1 R, 20; 74/214, 74/215, 216, 230, 230.7; 184/15 R, 15 B; 291/1, 2; 106/36; 104/179; 242/47.08, 47.09; 198/835, 497, 499

[56] References Cited

U.S. PATENT DOCUMENTS

| | | | |
|---|---|---|---|
| 1,943,917 | 1/1934 | Josky | 291/1 |
| 2,859,864 | 11/1958 | Ibaugh et al. | 198/497 |
| 3,093,399 | 5/1963 | Smith | 291/2 |
| 3,440,894 | 4/1969 | Hananann | 74/200 |
| 3,838,752 | 10/1974 | Berkovitz | 187/20 |

FOREIGN PATENT DOCUMENTS

| | | | |
|---|---|---|---|
| 857246 | 12/1960 | United Kingdom | 291/1 |
| 538969 | 1/1977 | U.S.S.R. | 187/1 R |

*Primary Examiner*—James L. Rowland

*Attorney, Agent, or Firm*—Oblon, Fisher, Spivak, McClelland & Maier

[57] ABSTRACT

A traction machine of a traction type elevator with a detector operable at occurence of abnormal car traveling. The traction machine includes a painting system to operate at the necessary time to paint the traction surface of a traction sheave of the elevator and at least one of main ropes near the traction sheave with a friction increasing material. It may include a foreign material remover to operate at the necessary time to rub the traction surface of the traction sheave. The painting system and the foreign material remover are driven through the operation of the detector.

2 Claims, 4 Drawing Figures

TRACTION MACHINE OF ELEVATOR

BACKGROUND OF THE INVENTION

The present invention relates to a traction machine of a traction type elevator.

When a car of elevator is stopped, the traction machine generally is so controlled that the car decelerates along a given deceleration curve. In the case of high speed elevator system, when the car travels on the terminal portion of a hoistway, the given deceleration curve and its corresponding actual speed of the car are compared and if the car actual speed is higher than the given deceleration, the traction machine is braked. Alternately, when the car passes the given portion of the terminal of the hoistway at a higher speed than the given speed, the traction machine is braked through a speed governor. In this manner, when the car travels abnormally on the terminal portion of the hoistway, the car is decelerated to prevent an accident at the terminal portion. In this case, the car is subjected to a larger deceleration than that when the car normally stops. The traction type elevator is driven by friction between the traction sheave and the main rope. For this, when the traction machine, i.e. the traction sheave, is braked in order to correct the abnormal travel, particularly when the car travels down with the maximum load, there is a high possibility that there will occur a slip of the main rope. Therefore, it can possibly fail to obtain a desired deceleration operation, resulting in occurence of an accident at the terminal of the hoistway.

One of the ways to improve friction between the traction sheave and the main rope is to increase the winding angle of the main rope. However, this is impracticable since there are many restrictions of disposition of elevator system. Another way to improve the friction is to change the main rope groove shape of the traction sheave. According to this method, the surface pressure of the groove is increased to further its wear, resulting in shortening the elevator lifetime. Still another way is to press the main rope out the groove by separately provided roller or the like. This also is followed by increase of the surface pressure and the lifetime of the elevator is shortened. Yet another way is to impregnate the main rope with a friction increasing material such as VANOL oil, asphalt rope grease, or the like. This considerably reduces the lifetime for bent fatigue.

SUMMARY OF THE INVENTION

Accordingly, the primary object of the invention is to provide a traction machine of an elevator to increase the traction force at the necessary time, with a view of overcoming the above-mentioned disadvantages.

According to one aspect of the invention, there is provided a traction machine of a traction type elevator with a detector operable at occurrence of abnormal car travelling, comprising a painting system to the necessary time to paint at least one of the traction surface of a traction sheave of the elevator and main ropes near the traction sheave with friction increasing material. The painting system is driven through the operation of the detector. The traction machine may further include a foreign material removing means to operate at the necessary time to rub the traction surface of the traction sheave. The foreign material removing means also is driven through the operation of the detector.

BRIEF DESCRIPTION OF DRAWINGS

Other objects and features of the invention will be apparent from the following description taken in connection with the accompanying drawings, wherein.

DESCRIPTION OF THE PREFERRED EMBODIMENTS

Figure 1:
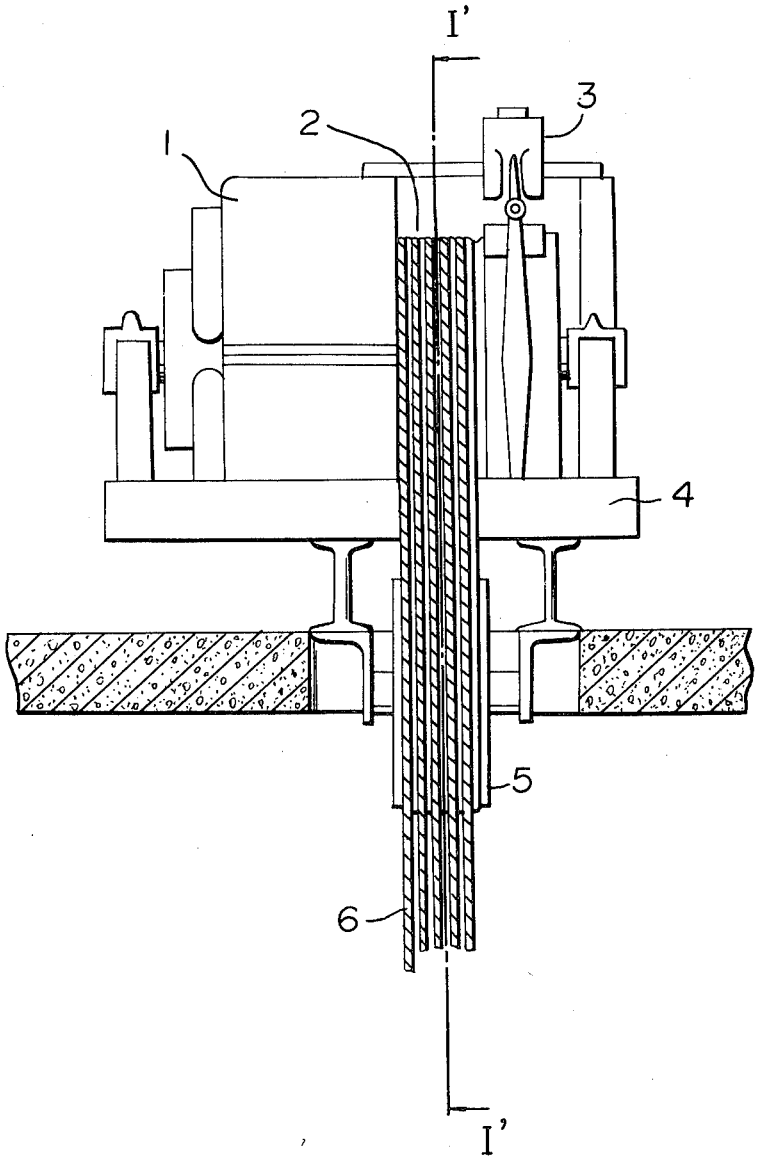
FIG. 1 is a front view schematically illustrating a traction machine elevator.

An embodiment of a traction apparatus according to the present invention will be described with reference to FIGS. 1 to 3.

In the figures is shown, (1) a traction machine, (2) a traction sheave, (3) a mechanical type brake, (4) a foundation of the traction machine (1), (5) a deflector wheel, (6) a main rope around the traction sheave (2) and the deflector wheel (5), (7) an elevator car, (8) a counterweight, (9) a painting system provided on the foundation (4), (10) a paint means for jetting friction increasing material such as rope grease of asphalt onto the traction sheave (2) and the main rope near the traction wheel, the sprayer being held by the painting system, (11) a drive means such as an electromagnet which attracts a lever **(11*a*) when it is energized and pushes the paint means (10) to drive it, (12) a normally open contact of a first detector which operates when the car (7) travels a given position of the terminal of the hoistway at a given speed or more, (13) an auxiliary relay, (13*a*) a normally open contact of time release, (14)** a second detector which produces an output signal when the deceleration of the car travelling the hoistway terminal is smaller than a given deceleration curve, and stops its output signal when it is larger than that, and (+) and (−) a power source.

Assume now that the car travels in a normal condition, that is, the car travelling is not abnormal. Under this condition, the contact (12) of the first detector is released, and the first detector produces no output signal and therefore the paint means (10) does not operate. And, if there occurs an abnormal travelling of the car (7) and the first detector operates, the contact (12) closes to form a path (+)-(12)-(13)-(−) and therefore the auxiliary relay (13) is energized to close the contact **(13*a*). Then, the drive means (11) is driven through a path (+)-(13*a*)-(11)-(−). As a result, the paint means (10) is pushed to operate so that it paints the traction sheave (2) and the main rope (6) with friction increasing material. This increases the drive force of the traction machine to prevent the main rope (6) at the abnormal travelling from slipping and to obtain a desired deceleration. In this way, accidents due to poor deceleration in the abnormal travelling is preventable without being accompanied by lifetime reduction. A predetermined time after energization of the auxiliary relay (13), the contact (13a) is released to stop the operation of the paint means (10). When the abnormal travelling of the car (7) takes place and the second detector (14) operates, a circuit (+)-(14)-(11)-(−) is formed to energize the drive means (11)** to initiate the spraying of the friction increasing material. The spraying ceases when the abnormal travelling is eliminated. The result is that the effect is attained which is similar to that resulting from the operation of the first detector.

In this example, similar effects may be attained in such a case that the paint means (10) is constructed by a brush or the like and the drive means (11) drives it to move to paint the traction sheave (2) and the like with friction increasing material.

Figure 3:
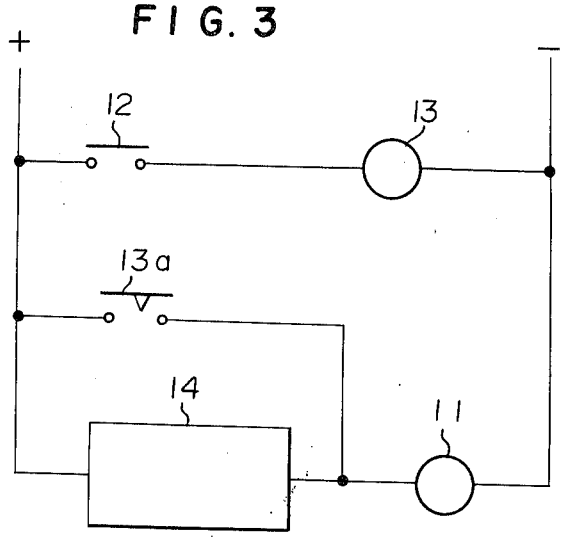
FIG. 3 is a circuit diagram of the chief portion of FIG. 2.
Figure 4:
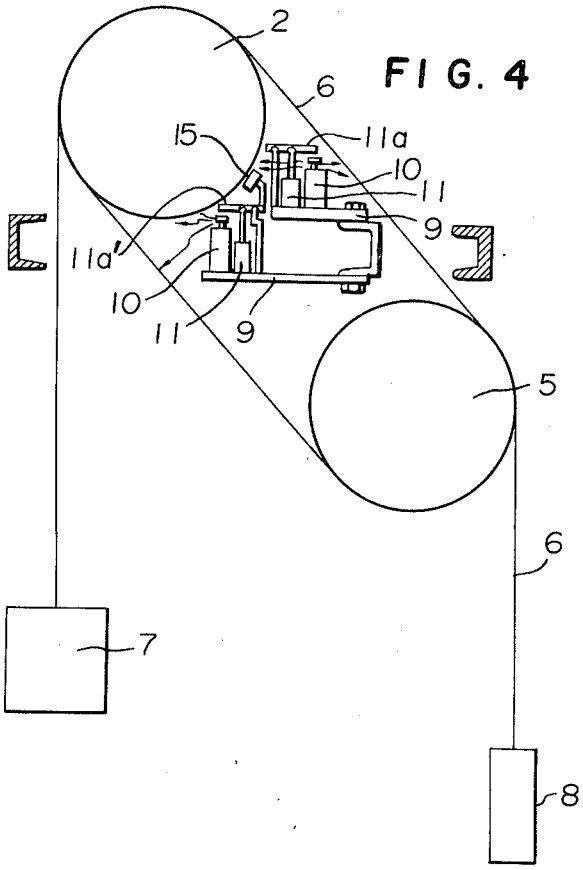
FIG. 4 is a view corresponding to the FIG. 2 view illustrating another embodiment of the traction machine according to the invention.

FIG. 4 shows another embodiment of the traction apparatus according to the invention. In the figure, like reference numerals designate like portions in FIGS. 1 to 3. A couple of painting systems (9) are provided and (11*a*′) designates a lever pivoted at the intermediate point on the fixed portion of one of the painting systems (9). One side of the lever is coupled with the drive means (11), by which the painting means (10) is pushed. (15) designates a foreign matter remover such as a rubbing body made of polyurethane foam or the like and the remover is fixed on the other side terminal of the lever (11*a*′). The remover also is disposed facing the traction surface of the traction sheave (2) and, in a normal condition, positioned apart from the traction surface.

Figure 2:
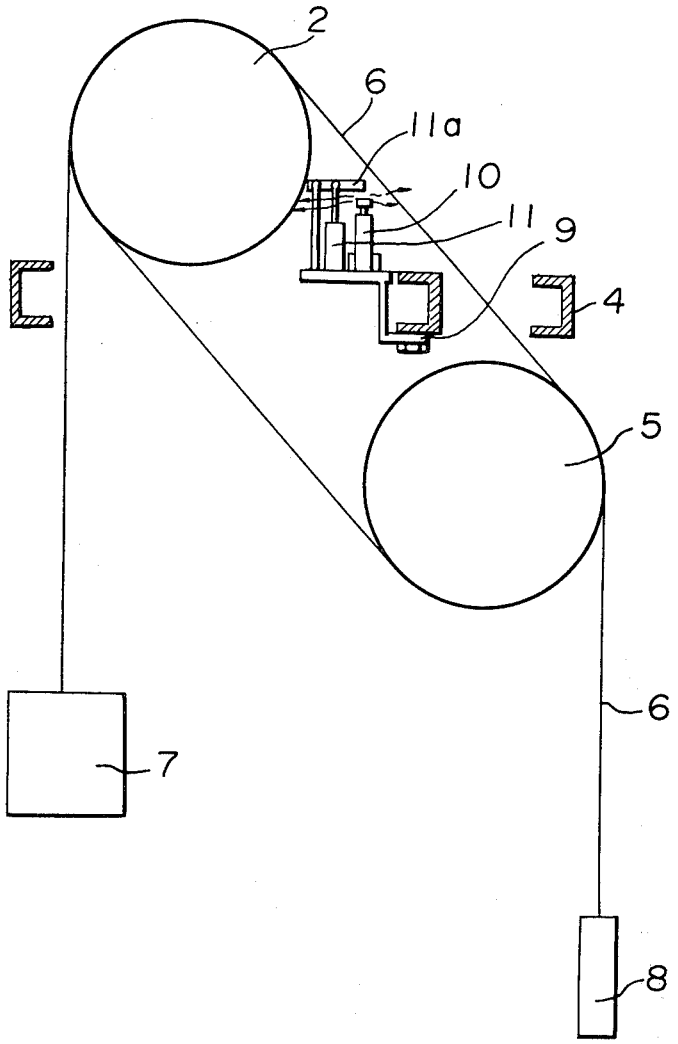
FIG. 2 is a cross sectional view of an embodiment of a traction machine according to the invention, taken on line I'—I' of FIG. 1.

When abnormal travel occurs in the travelling of the car (7), the paint means (10) operates as in the embodiment shown in FIGS. 1 to 3 and at the same time the traction surface of the traction sheave (2) is rubbed by the foreign matter remover. The rubbing removes foreign matter such as frictional particles to reduce the traction force of the traction machine (1). The foreign matters is attached onto the traction surface of the traction machine (1). Accordingly, this embodiment ensures a desired deceleration of the car (7) in addition to the useful operation of the embodiment shown in FIGS. 1 to 3, although its elaboration is omitted. In this example, the foreign material remover (5) is provided at both sides with painting means (10) since there is a possibility to wipe out the friction increasing material by the foreign material remover (15). However, the traction force may be increased at the rotation of the traction sheave (2) to the right and left.

As described above, the traction apparatus of the invention includes a painting system which is disposed facing at least one of the traction surface of the traction sheave of a traction type elevator and the main ropes near the traction sheave. When abnormal travelling of the car occurs, the detector for detecting such drives the painting system to paint at least one of the traction sheave and the main ropes with friction increasing material. At this time, the detector drives the foreign material remover for removing foreign materials on the traction surface of the traction sheave. As a result, the traction force of the traction machine is increased at the occurrence of abnormal travel of the car. The slip of the main rope is prevented without reduction of the lifetime of the traction machine such as by wear of the main rope. Additionally, an accident caused by poor deceleration as a result of abnormal elevator car travel may be prevented economically.

What is claimed is:

1. In a traction machine of a traction type elevator, a detector for detecting occurrence of abnormal car travelling, paint means operated by said abnormal car travelling occurrence detector for painting at least one of the traction surfaces of a traction sheave of said elevator and main ropes near the traction sheave with friction increasing material, and means operated by said detector for rubbing said traction surface to remove foreign material.

2. The traction machine recited in claim 1 including:

a pivotally mounted lever, drive means operated by said detector for pivoting said lever, and means responsive to the pivoting of said lever for rubbing said traction surface to remove foreign material.

* * * * *